US009668636B2

(12) United States Patent
Tuller et al.

(10) Patent No.: US 9,668,636 B2
(45) **Date of Patent: *Jun. 6, 2017**

(54) METHOD AND APPARATUS FOR DISHWASHER WITH COMMON HEATING ELEMENT FOR MULTIPLE TREATING CHAMBERS

(71) Applicant: Whirlpool Corporation, Benton Harbor, MI (US)

(72) Inventors: Barry E. Tuller, Stevensville, MI (US); Alvaro Vallejo Noriega, Saint Joseph, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 575 days.

This patent is subject to a terminal disclaimer.

(21) Appl. No.: 13/860,546

(22) Filed: Apr. 11, 2013

(65) Prior Publication Data

US 2013/0186437 A1 Jul. 25, 2013

Related U.S. Application Data

(63) Continuation-in-part of application No. 12/947,317, filed on Nov. 16, 2010, now Pat. No. 9,113,766.

(51) Int. Cl.

| | |
|---|---|
| ***A47L 15/42*** | (2006.01) |
| ***A47L 15/00*** | (2006.01) |
| ***A47L 15/48*** | (2006.01) |

(52) U.S. Cl.
CPC ..... *A47L 15/4251* (2013.01); *A47L 15/0034* (2013.01); *A47L 15/0047* (2013.01);
(Continued)

(58) Field of Classification Search
CPC ..... A47L 15/4251; A47L 15/0047; A47L 15/0084; A47L 15/0034; A47L 15/48;
(Continued)

(56) References Cited

U.S. PATENT DOCUMENTS

| | | | |
|---|---|---|---|
| 1,617,021 | A | 2/1927 | Mitchell |
| 2,154,559 | A | 4/1939 | Bilde |

(Continued)

FOREIGN PATENT DOCUMENTS

| | | |
|---|---|---|
| CH | 169630 | 6/1934 |
| CN | 2571812 | 9/2003 |

(Continued)

OTHER PUBLICATIONS

European Search Report for EP12188007, Aug. 6, 2013.

(Continued)

*Primary Examiner* — Michael Barr
*Assistant Examiner* — Benjamin L Osterhout
(74) *Attorney, Agent, or Firm* — McGarry Bair PC

(57) ABSTRACT

A dishwasher with multiple physically separate treating chambers includes an air supply system selectively supplying drying air to the treating chambers, and a drying air exhaust system selectively removing drying air from the treating chambers. A method for operating a dishwasher selectively supplies heated drying air to and exhausts drying air from at least one treating chamber.

20 Claims, 9 Drawing Sheets

(52) U.S. Cl.
CPC ..... *A47L 15/0084* (2013.01); *A47L 15/48* (2013.01); *A47L 15/4285* (2013.01); *A47L 2501/06* (2013.01); *A47L 2501/10* (2013.01); *A47L 2501/11* (2013.01)

(58) Field of Classification Search
CPC ..... A47L 15/4285; A47L 2501/10; A47L 2501/11; A47L 2501/06
See application file for complete search history.

(56) References Cited

U.S. PATENT DOCUMENTS 2,422,022 A 6/1947 Koertge
2,734,122 A 2/1956 Flannery
3,016,147 A 1/1962 Cobb et al.
3,026,628 A 3/1962 Berger Sr. et al.
3,068,877 A 12/1962 Jacobs
3,103,227 A 9/1963 Long
3,122,148 A 2/1964 Alabaster
3,186,417 A 6/1965 Fay
3,288,154 A 11/1966 Jacobs
3,378,933 A 4/1968 Jenkins
3,542,594 A 11/1970 Smith et al.
3,575,185 A 4/1971 Barbulesco
3,586,011 A 6/1971 Mazza
3,739,145 A 6/1973 Woehler
3,801,280 A 4/1974 Shah et al.
3,846,321 A 11/1974 Strange
3,906,967 A 9/1975 Bergeson
3,989,054 A 11/1976 Mercer
4,179,307 A 12/1979 Cau et al.
4,180,095 A 12/1979 Woolley et al.
4,228,962 A 10/1980 Dingler et al.
4,326,552 A 4/1982 Bleckmann
4,754,770 A 7/1988 Fornasari
5,002,890 A 3/1991 Morrison
5,030,357 A 7/1991 Lowe
5,133,863 A 7/1992 Zander
5,331,986 A 7/1994 Lim et al.
5,454,298 A 10/1995 Lu
5,470,142 A 11/1995 Sargeant et al.
5,470,472 A 11/1995 Baird et al.
5,557,704 A 9/1996 Dennis et al.
5,569,383 A 10/1996 Vander Ark, Jr. et al.
5,618,424 A 4/1997 Nagaoka
5,630,437 A 5/1997 Dries et al.
5,711,325 A 1/1998 Kloss et al.
5,755,244 A * 5/1998 Sargeant ..... A47L 15/0084 134/178
5,782,112 A 7/1998 White et al.
5,803,100 A 9/1998 Thies
5,865,997 A 2/1999 Isaacs
5,868,937 A 2/1999 Back et al.
5,904,163 A 5/1999 Inoue et al.
5,924,432 A 7/1999 Thies et al.
6,289,908 B1 9/2001 Kelsey
6,389,908 B1 5/2002 Chevalier et al.
6,443,091 B1 9/2002 Matte
6,460,555 B1 10/2002 Tuller et al.
6,491,049 B1 12/2002 Tuller et al.
6,601,593 B2 8/2003 Deiss et al.
6,666,976 B2 12/2003 Benenson, Jr. et al.
6,800,197 B1 10/2004 Kosola et al.
6,997,195 B2 2/2006 Durazzani et al.
7,047,986 B2 5/2006 Ertle et al.
7,069,181 B2 6/2006 Jerg et al.
7,093,604 B2 8/2006 Jung et al.
7,153,817 B2 12/2006 Binder
7,198,054 B2 4/2007 Welch
7,208,080 B2 4/2007 Batten et al.
7,232,494 B2 6/2007 Rappette
7,250,174 B2 7/2007 Lee et al.
7,270,132 B2 9/2007 Inui et al.
7,319,841 B2 1/2008 Bateman, III et al.
7,326,338 B2 2/2008 Batten et al.
7,347,212 B2 3/2008 Rosenbauer
7,350,527 B2 4/2008 Gurubatham et al.
7,363,093 B2 4/2008 King et al.
7,406,843 B2 8/2008 Thies et al.
7,445,013 B2 11/2008 VanderRoest et al.
7,497,222 B2 3/2009 Edwards et al.
7,523,758 B2 4/2009 VanderRoest et al.
7,594,513 B2 9/2009 VanderRoest et al.
7,819,983 B2 10/2010 Kim et al.
7,896,977 B2 3/2011 Gillum et al.
8,043,437 B1 10/2011 Delgado et al.
8,161,986 B2 4/2012 Alessandrelli
8,215,322 B2 7/2012 Fountain et al.
8,667,974 B2 3/2014 Fountain et al.
8,746,261 B2 6/2014 Welch
9,005,369 B2 4/2015 Delgado et al.
9,034,112 B2 5/2015 Tuller et al.
2002/0017483 A1 2/2002 Chesner et al.
2003/0037809 A1 2/2003 Favaro
2003/0168087 A1 9/2003 Inui et al.
2003/0205248 A1 11/2003 Christman et al.
2004/0007253 A1 1/2004 Jung et al.
2004/0103926 A1 6/2004 Ha
2004/0254654 A1 12/2004 Donnelly et al.
2005/0022849 A1 2/2005 Park et al.
2005/0133070 A1 6/2005 Vanderroest et al.
2006/0005863 A1 1/2006 Gurubatham et al.
2006/0054549 A1 3/2006 Schoendorfer
2006/0123563 A1 6/2006 Raney et al.
2006/0162744 A1 7/2006 Walkden
2006/0174915 A1 8/2006 Hedstrom et al.
2006/0236556 A1 10/2006 Ferguson et al.
2006/0237049 A1 10/2006 Weaver et al.
2006/0237052 A1 10/2006 Plcardat et al.
2007/0006898 A1 1/2007 Lee
2007/0107753 A1 5/2007 Jerg
2007/0119478 A1 5/2007 King et al.
2007/0124004 A1 5/2007 King et al.
2007/0163626 A1 7/2007 Klein
2007/0186964 A1 8/2007 Mason et al.
2007/0246078 A1 10/2007 Purtilo et al.
2007/0266587 A1 11/2007 Brigewatt et al.
2007/0295360 A1 12/2007 Jerg et al.
2008/0116135 A1 5/2008 Rieger et al.
2008/0289654 A1 11/2008 Kim et al.
2008/0289664 A1 11/2008 Rockwell et al.
2009/0095330 A1 4/2009 Iwanaga et al.
2009/0283111 A1 11/2009 Classen et al.
2010/0012159 A1 1/2010 Verma et al.
2010/0043826 A1 2/2010 Bertsch et al.
2010/0043828 A1 2/2010 Choi et al.
2010/0043847 A1 2/2010 Yoon et al.
2010/0121497 A1 5/2010 Heisele et al.
2010/0147339 A1 6/2010 Bertsch et al.
2010/0154830 A1 6/2010 Lau et al.
2010/0154841 A1 6/2010 Fountain et al.
2010/0175762 A1 7/2010 Anacrelico
2010/0224223 A1 9/2010 Kehl et al.
2010/0252081 A1 10/2010 Classen et al.
2010/0300499 A1 12/2010 Han et al.
2011/0061682 A1 3/2011 Fountain et al.
2011/0120508 A1 5/2011 Yoon et al.
2011/0126865 A1 6/2011 Yoon et al.
2011/0146714 A1 6/2011 Fountain et al.
2011/0146730 A1 6/2011 Welch
2011/0146731 A1 6/2011 Fountain et al.
2012/0097200 A1 4/2012 Fountain
2012/0118330 A1 5/2012 Tuller et al.
2012/0118336 A1 5/2012 Welch
2012/0138096 A1 6/2012 Tuller et al.
2012/0138106 A1 6/2012 Fountain et al.
2012/0138107 A1 6/2012 Fountain et al.
2012/0291805 A1 11/2012 Tuller et al.
2012/0291822 A1 11/2012 Tuller et al.
2012/0318295 A1 12/2012 Delgado et al.
2012/0318296 A1 12/2012 Fountain et al.
2012/0318308 A1 12/2012 Fountain et al.
2012/0318309 A1 12/2012 Tuller et al.

(56) References Cited

U.S. PATENT DOCUMENTS

FOREIGN PATENT DOCUMENTS

| | | | |
|---|---|---|---|
| CN | 2761660 | | 3/2006 |
| CN | 1966129 | | 5/2007 |
| CN | 2907830 | | 6/2007 |
| CN | 101406379 | | 4/2009 |
| CN | 201276653 | | 7/2009 |
| CN | 201361486 | | 12/2009 |
| CN | 101654855 | | 2/2010 |
| CN | 201410325 | | 2/2010 |
| CN | 201473770 | | 5/2010 |
| DE | 1134489 | | 8/1961 |
| DE | 1428358 | A1 | 11/1968 |
| DE | 1453070 | | 3/1969 |
| DE | 7105474 | | 8/1971 |
| DE | 7237309 | U | 9/1973 |
| DE | 2825242 | A1 | 1/1979 |
| DE | 3337369 | A1 | 4/1985 |
| DE | 3723721 | A1 | 5/1988 |
| DE | 3842997 | A1 | 7/1990 |
| DE | 4011834 | A1 | 10/1991 |
| DE | 4016915 | A1 | 11/1991 |
| DE | 4131914 | A1 | 4/1993 |
| DE | 9415486 | U1 | 11/1994 |
| DE | 9416710 | U1 | 1/1995 |
| DE | 4413432 | C1 | 8/1995 |
| DE | 4418523 | A1 | 11/1995 |
| DE | 4433842 | | 3/1996 |
| DE | 69111365 | T2 | 3/1996 |
| DE | 19546965 | A1 | 6/1997 |
| DE | 69403957 | T2 | 1/1998 |
| DE | 19652235 | | 6/1998 |
| DE | 10000772 | A1 | 7/2000 |
| DE | 69605965 | T2 | 8/2000 |
| DE | 19951838 | A1 | 5/2001 |
| DE | 10065571 | A1 | 7/2002 |
| DE | 10106514 | A1 | 8/2002 |
| DE | 60206490 | T2 | 5/2006 |
| DE | 60302143 | | 8/2006 |
| DE | 102005023428 | A1 | 11/2006 |
| DE | 102005038433 | A1 | 2/2007 |
| DE | 102007007133 | A1 | 8/2008 |
| DE | 102007060195 | A1 | 6/2009 |
| DE | 202010006739 | U1 | 8/2010 |
| DE | 102009027910 | A1 | 1/2011 |
| DE | 102009028278 | A1 | 2/2011 |
| DE | 102010061215 | A1 | 6/2011 |
| DE | 102011052846 | A1 | 5/2012 |
| DE | 102012103435 | A1 | 12/2012 |
| EP | 0068974 | A1 | 1/1983 |
| EP | 0178202 | A1 | 4/1986 |
| EP | 0198496 | A1 | 10/1986 |
| EP | 0208900 | A2 | 1/1987 |
| EP | 0370552 | A1 | 5/1990 |
| EP | 0374616 | A1 | 6/1990 |
| EP | 0383028 | A2 | 8/1990 |
| EP | 0405627 | A1 | 1/1991 |
| EP | 437189 | A1 | 7/1991 |
| EP | 0454640 | A1 | 10/1991 |
| EP | 0521815 | A1 | 1/1993 |
| EP | 0585905 | A2 | 9/1993 |
| EP | 0702928 | A1 | 8/1995 |
| EP | 0597907 | B1 | 12/1995 |
| EP | 0725182 | A1 | 8/1996 |
| EP | 0748607 | A2 | 12/1996 |
| EP | 0752231 | A1 | 1/1997 |
| EP | 752231 | A1 | 1/1997 |
| EP | 0854311 | A2 | 7/1998 |
| EP | 0855165 | A2 | 7/1998 |
| EP | 0898928 | A1 | 3/1999 |
| EP | 1029965 | A1 | 8/2000 |
| EP | 1224902 | A2 | 7/2002 |
| EP | 1256308 | A2 | 11/2002 |
| EP | 1264570 | | 12/2002 |
| EP | 1319360 | A1 | 6/2003 |
| EP | 1342827 | | 9/2003 |
| EP | 1346680 | A2 | 9/2003 |
| EP | 1386575 | A1 | 2/2004 |
| EP | 1415587 | | 5/2004 |
| EP | 1498065 | A1 | 1/2005 |
| EP | 1583455 | A1 | 10/2005 |
| EP | 1703834 | A1 | 9/2006 |
| EP | 1743871 | A1 | 1/2007 |
| EP | 1862104 | A1 | 12/2007 |
| EP | 1882436 | A1 | 1/2008 |
| EP | 1980193 | A1 | 10/2008 |
| EP | 2127587 | A1 | 2/2009 |
| EP | 2075366 | A1 | 7/2009 |
| EP | 2138087 | A1 | 12/2009 |
| EP | 2332457 | A1 | 6/2011 |
| EP | 2335547 | A1 | 6/2011 |
| EP | 2338400 | A1 | 6/2011 |
| EP | 2351507 | A1 | 8/2011 |
| FR | 1370521 | A | 8/1964 |
| FR | 2372363 | A1 | 6/1978 |
| FR | 2491320 | A1 | 4/1982 |
| FR | 2491321 | A1 | 4/1982 |
| FR | 2790013 | A1 | 8/2000 |
| GB | 973859 | A | 10/1964 |
| GB | 1047948 | | 11/1966 |
| GB | 1123789 | A | 8/1968 |
| GB | 1515095 | | 6/1978 |
| GB | 2274772 | A | 8/1994 |
| JP | 55039215 | A | 3/1980 |
| JP | 60069375 | A | 4/1985 |
| JP | 61085991 | A | 5/1986 |
| JP | 61200824 | | 9/1986 |
| JP | 1005521 | A | 1/1989 |
| JP | 1080331 | A | 3/1989 |
| JP | 5245094 | A | 9/1993 |
| JP | 07178030 | | 7/1995 |
| JP | 10109007 | A | 4/1998 |
| JP | 2000107114 | A | 4/2000 |
| JP | 2001190479 | A | 7/2001 |
| JP | 2001190480 | A | 7/2001 |
| JP | 2003336909 | A | 12/2003 |
| JP | 2003339607 | A | 12/2003 |
| JP | 2004267507 | A | 9/2004 |
| JP | 2005124979 | A | 5/2005 |
| JP | 2006075635 | A | 3/2006 |
| JP | 2007068601 | A | 3/2007 |
| JP | 2008093196 | A | 4/2008 |
| JP | 2008253543 | A | 10/2008 |
| JP | 2008264018 | A | 11/2008 |
| JP | 2008264724 | A | 11/2008 |
| JP | 2010035745 | A | 2/2010 |
| JP | 2010187796 | A | 9/2010 |
| KR | 20010077128 | | 8/2001 |
| KR | 20090006659 | | 1/2009 |
| WO | 2005058124 | A1 | 6/2005 |
| WO | 2005115216 | A1 | 12/2005 |
| WO | 2007024491 | A2 | 3/2007 |
| WO | 2007074024 | A1 | 7/2007 |
| WO | 2008067898 | A1 | 6/2008 |
| WO | 2008125482 | | 10/2008 |
| WO | 2009018903 | A1 | 2/2009 |
| WO | 2009065696 | A1 | 5/2009 |
| WO | 2009077266 | A1 | 6/2009 |
| WO | 2009077279 | A2 | 6/2009 |
| WO | 2009077280 | A1 | 6/2009 |
| WO | 2009077283 | A1 | 6/2009 |
| WO | 2009077286 | A1 | 6/2009 |
| WO | 2009077290 | A1 | 6/2009 |
| WO | 2009118308 | A1 | 10/2009 |

OTHER PUBLICATIONS

German Search Report for DE102013103264, Jul. 12, 2013.

German Search Report for DE102013103625, Jul. 19, 2013.

German Search Report for Counterpart DE102013109125, Dec. 9, 2013.

Ishihara et al., JP 11155792 A, English Machine Translation, 1999, pp. 1-14.

(56) References Cited

OTHER PUBLICATIONS

German Search Report for Counterpart DE102014101260.7, Sep. 18, 2014.
European Search Report for EP11188106, Mar. 29, 2012.
German Search Report for DE102010061347, Jan. 23, 2013.
German Search Report for DE102010061215, Feb. 7, 2013.
German Search Report for DE102010061346, Sep. 30, 2011.
German Search Report for DE102010061343, Jul. 7, 2011.
German Search Report for DE102011053666, Oct. 21, 2011.
German Search Report for DE102010061342, Aug. 19, 2011.
European Search Report for EP101952380, May 19, 2011.

* cited by examiner

METHOD AND APPARATUS FOR DISHWASHER WITH COMMON HEATING ELEMENT FOR MULTIPLE TREATING CHAMBERS

CROSS-REFERENCE TO RELATED APPLICATION

This application is a continuation-in-part of pending U.S. patent application Ser. No. 12/947,317, filed Nov. 16, 2010, now U.S. Pat. No. 9,113,766 issued Aug. 25, 2015, which is incorporated herein by reference in its entirety.

BACKGROUND OF THE INVENTION

Dishwashers can include multiple compartments in the form of multiple drawers or pull-out compartments slidably mounted in a cabinet. Each compartment can include a tub at least partially defining a treating chamber. Typically, a dish rack is provided in each treating chamber to support utensils during a treating cycle of operation. In most multi-compartment dishwashers, duplicate components, including duplicate pumps, sumps, and heaters, are provided for each treating chamber for carrying out a cycle of operation in one or both of the treating chambers. Additionally, separate heaters are normally employed for heating liquid used to wash the utensils and heating air used to dry the utensils.

SUMMARY OF THE INVENTION

The invention relates to a method and apparatus directed to the selective control of utensil drying airflow individually or concurrently into and out of one or more multiple treating chambers in a dishwasher.

DESCRIPTION OF EMBODIMENTS OF THE INVENTION

Figure 1:
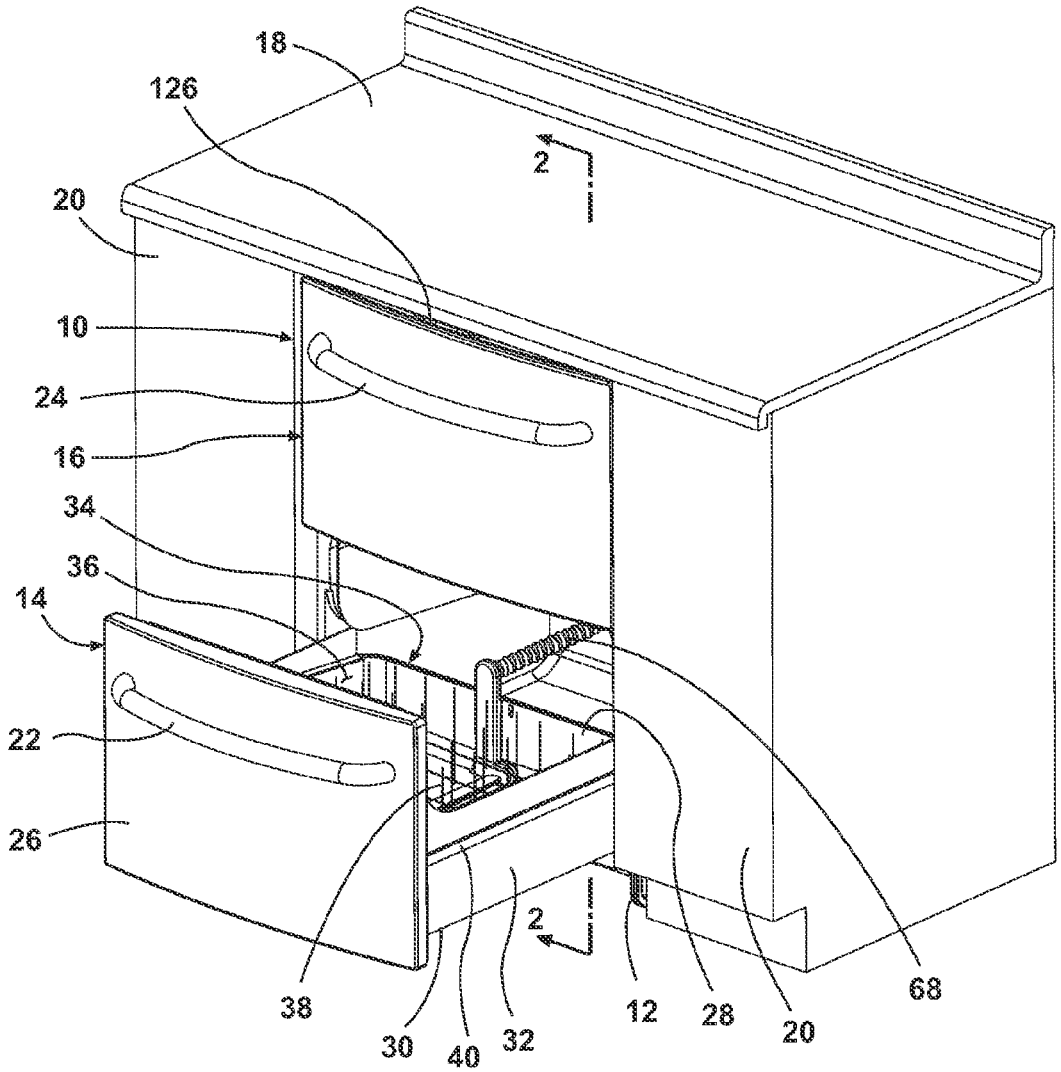
FIG. 1 is a perspective view of a multi-compartment dishwasher according to a first embodiment of the present invention having an upper compartment in a closed position and a lower compartment in an open position.

FIG. 1 is a perspective view of a dishwasher 10 according to the present invention. Although the actual dishwasher 10 into which the present invention may be incorporated can vary, the invention is shown in connection with dishwasher 10 depicted as a multi-compartment drawer-type dishwasher. The dishwasher 10 includes an outer housing or frame 12 having a lower compartment 14 and an upper compartment 16 arranged below a countertop 18 between cabinetry 20, which may include one or more drawers or cabinet drawers (not shown). As best illustrated in FIG. 1, the lower and upper compartments 14, 16 take the form of slide-out drawer units of similar size, each having a handle 22, 24, respectively, for facilitating movement of the drawer units between an open and closed position. However, one compartment 14, 16 can have a small or medium capacity so as to be used for washing smaller or more delicate utensils, such as glassware and the like, while the other compartment 14, 16 can be a larger capacity drawer for washing larger or more robust utensils, such as dinnerware, cookware and other large sized objects. Also, the dishwasher 10 could include a combination single pull-out drawer unit and a conventional dishwashing unit, with a hinged door. As used in this description, the term "utensil(s)" is intended to be generic to any item, single or plural, that may be treated in the dishwasher 10, including, without limitation; dishes, plates, pots, bowls, pans, glassware, and silverware.

Lower compartment 14 is shown in the open position in FIG. 1, and includes a front wall 26, a rear wall 28, a bottom wall 30 and opposing side walls 32 that collectively form a lower tub 34 that defines a lower treating chamber 36. The lower tub 34 is provided with a utensil rack 38 for supporting various objects, such as utensils and the like, to be exposed to a washing operation. Lower compartment 14 is slidingly supported within the outer housing through a pair of extendible support guides, one of which is indicated at 40.

Figure 2:
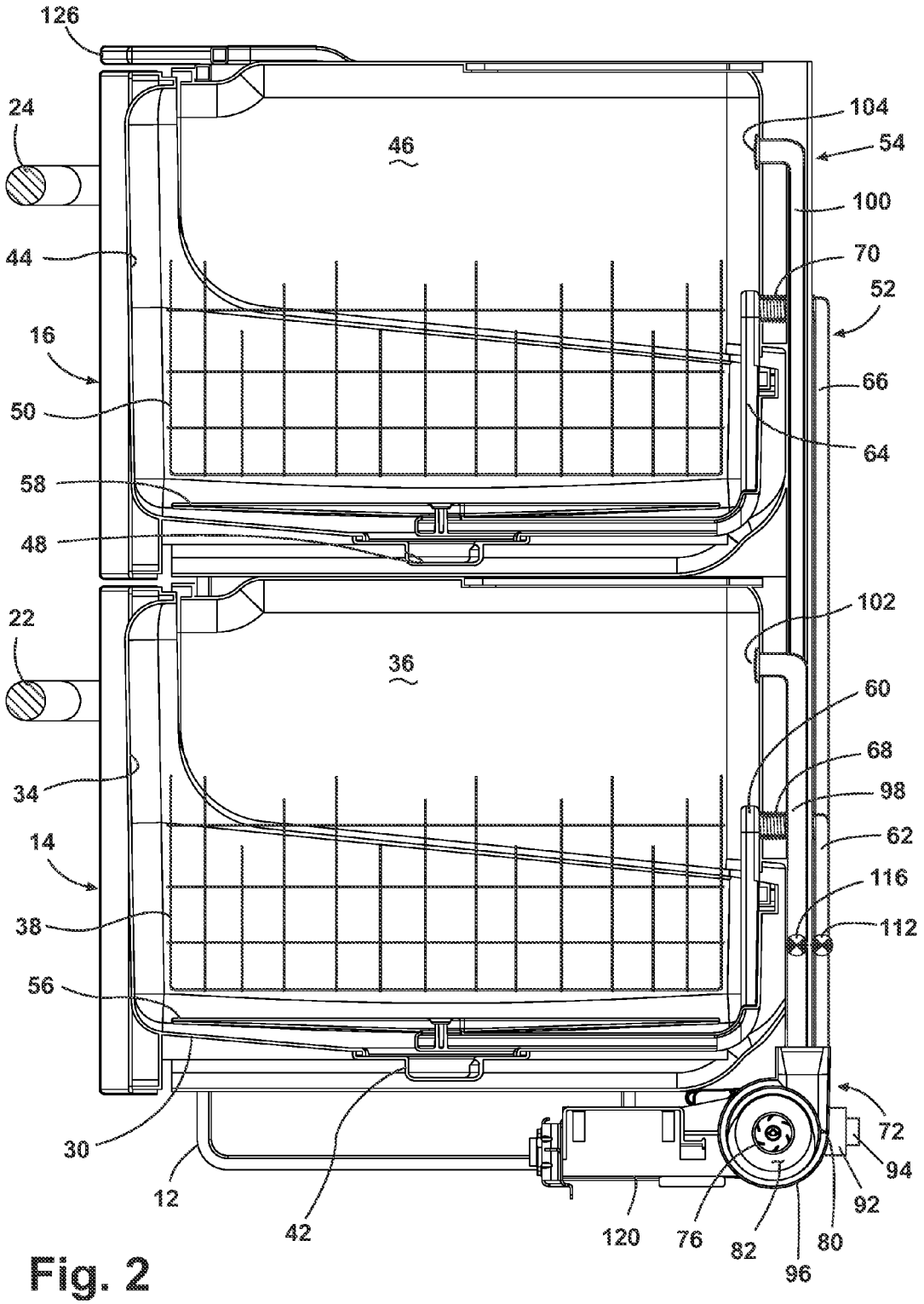
FIG. 2 is a cross-sectional view through line 2-2 of FIG. 1, with the upper and lower compartments shown in the closed position.

FIG. 2 is a cross-section view through line 2-2 of FIG. 1, with both compartments 14, 16 shown in the closed position. In the embodiment shown, the bottom wall 30 of the lower tub 34 may be sloped to define a lower tub region or tub sump 42 that, as will be discussed more fully below, manages a flow of washing fluid within lower compartment 14. Although not numbered in FIG. 2, upper compartment 16 similarly includes front, rear, bottom and opposing side walls that collectively form an upper tub 44 that defines an upper treating chamber 46 having a sump 48. The upper treating chamber 46 is physically separate from the lower treating chamber 36. The upper tub 44 can also be provided with a utensil rack 50 for supporting various objects, such as utensils and the like, to be exposed to a washing operation. Like the lower compartment 14, upper compartment 16 is slidingly supported within the outer housing through a pair of extendible support guides (not shown).

The dishwasher 10 includes a liquid supply system 52 and an air supply system 54, each of which is fluidly coupled to at least one of the lower and upper treating chambers 36, 46. For example, the liquid supply system 52 can be coupled to the lower treating chamber 36 and the air supply system 54 can be coupled to the upper treating chamber 46, or vice versa. As illustrated, the liquid supply system 52 is fluidly coupled to both treating chambers 36, 46 to selectively supply liquid to the tubs 34, 44 and the air supply system 54 is fluidly coupled to both treating chambers 36, 46 to selectively supply air to the tubs 34, 44.

The liquid supply system 54 includes a lower spray arm assembly 56 positioned in the lower tub 34 beneath the utensil rack 38 and an upper spray arm assembly 58 positioned in the upper tub 44 beneath the utensil rack 50. Each spray arm assembly 56, 58 is configured to rotate in their respective treating chamber 36, 46 and generate a spray of wash liquid in a generally upward direction, over a portion of the interior of their respective treating chamber 36, 46, typically directed to treat utensils located in the utensil racks 38, 50. While the spray arm assemblies 56, 58 are illustrated as rotating spray arms, the spray arm assemblies can be of any structure and configuration, such as fixed spray heads. Additional spray arms or nozzles can also be provided.

A first spray arm conduit 60 is provided in the lower tub 34 and is coupled at one end to the lower spray arm assembly 56. As illustrated, the first spray arm conduit 60 extends along the bottom wall 30 of the lower tub 34 from the lower spray arm assembly 56 and upwardly along the rear wall 28. A first supply conduit 62 is fluidly coupled to the first spray arm conduit 60 for supplying liquid to the spray arm assembly 56 via the first spray arm conduit 60. The upper tub 44 is provided with a second spray arm conduit 64 that is similar to the first spray arm conduit 60, and a second supply conduit 66 is fluidly coupled to the upper tub 44 for supplying liquid to the spray arm assembly 58 via the second spray arm conduit 64. Because the spray arm assemblies 56, 58 are positioned within the tubs 34, 44, the spray arm assemblies 56, 58 and the spray arm conduits 60, 64 must be able to move with the compartments 14, 16 as they move between the open and closed positions. As such, a flexible manifold tube 68, 70 can be fluidly coupled between each of the spray arm conduits 60, 64 and their associated supply conduits 62, 66 to allow for such movement. Alternatively, it has been contemplated that a docking-type connection may be used instead of the flexible manifold tubes 68, 70.

Figure 3:
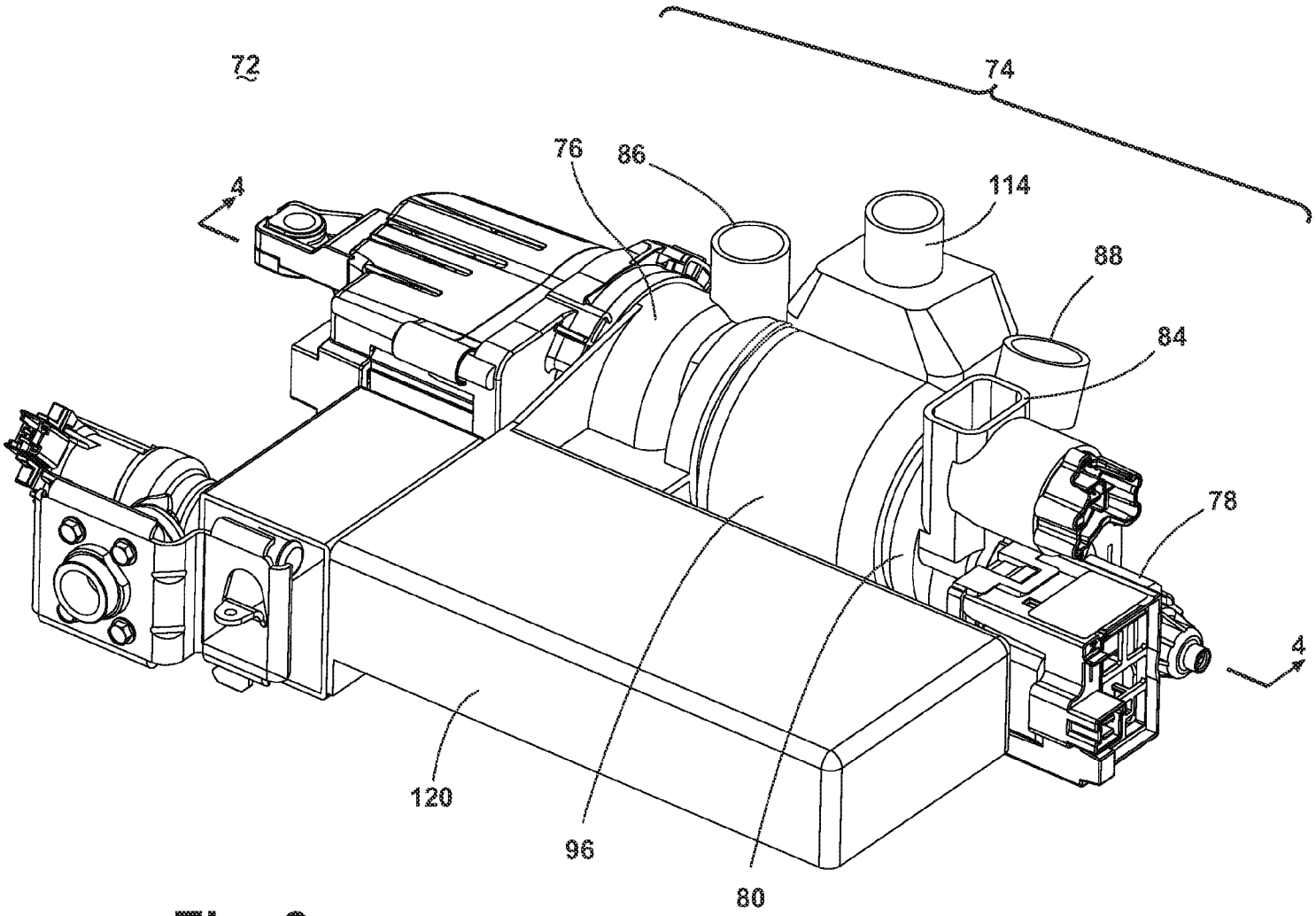
FIG. 3 is a perspective view of the remote pump/filtration/heating system in isolation from the dishwasher 10.
Figure 4:
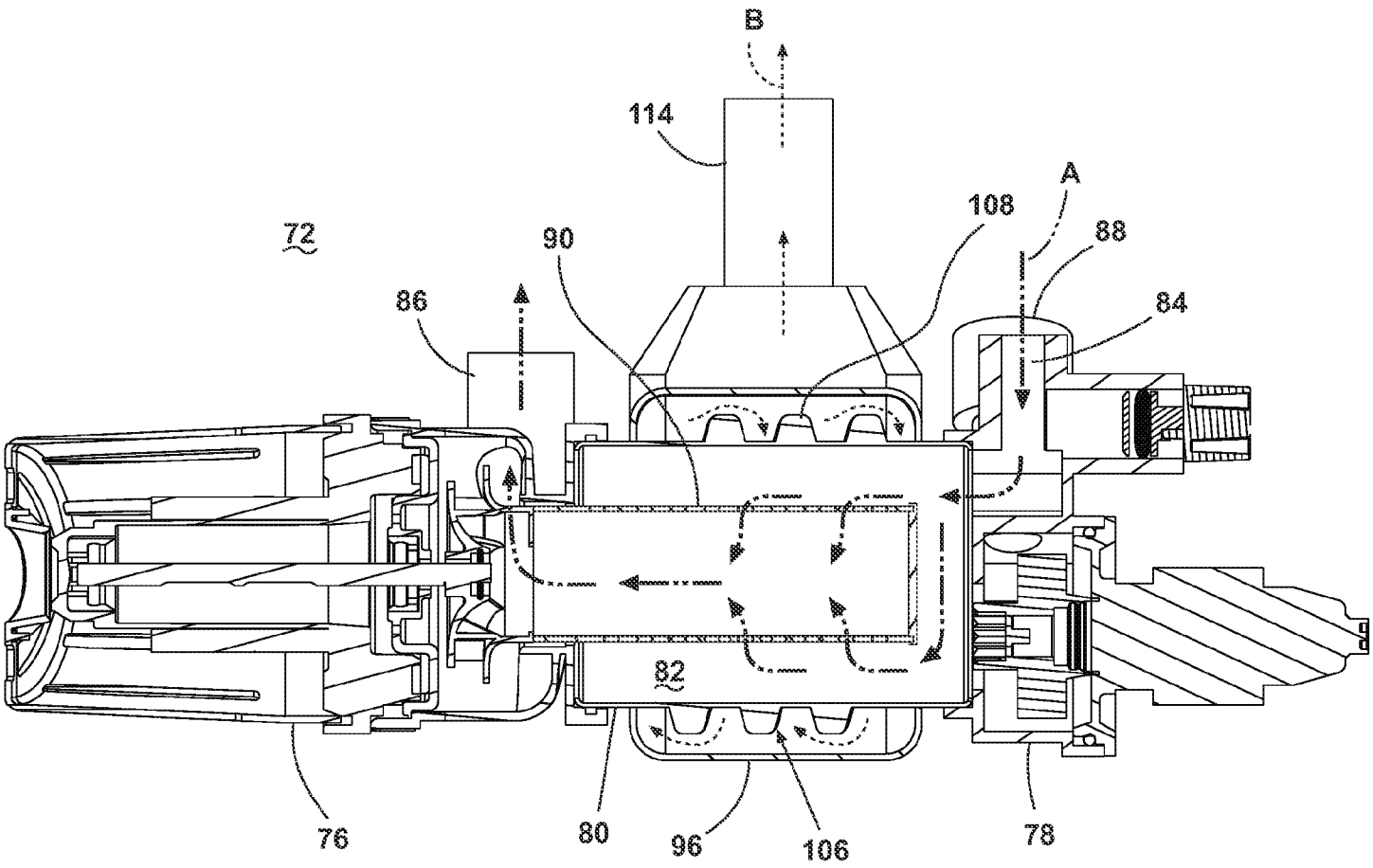
FIG. 4 is a cross-section view through line 4-4 of FIG. 3.

The liquid supply system 52 can further include a remote pump/filtration/heating system 72 for both compartments 14, 16. FIG. 3 is a perspective view of the remote pump/filtration/heating system 72 in isolation from the dishwasher 10 and FIG. 4 is a cross-section view through line 4-4 of FIG. 3. The remote pump/filtration/heating system 72 can include a single pump assembly 74 to pump liquid to the spray arm assemblies 56, 58. The pump assembly 74 may have both a recirculation pump 76 and a drain pump 78, which are fluidly coupled to a housing 80 defining a remote sump 82 for both treating chambers 36, 46. The remote sump 82 is in fluid communication with both tub sumps 34, 48 by conduits (not shown) that are both in fluid communication with a sump inlet conduit 84. The remote sump 82 may collect liquid supplied to both wash tubs 34, 44; as such, the housing 80 can be thought of as a liquid supply housing or conduit.

The recirculation pump 76 is fluidly coupled to the remote sump 82 and includes an outlet conduit 86 in communication with the first and second supply conduits 62 such that the recirculation pump 76 can selectively pump liquid through the supply conduits 62, 66 to each of the spray arm assemblies 56, 58. In this way, the recirculation pump 76 can redistribute wash liquid collecting in the remote sump 82 through the spray arm assemblies 56, 58 into the treating chambers 36, 46, where the liquid naturally flows back to the remote sump 82 via the tub sumps 42, 48 for recirculation or drainage, depending on the phase of the wash cycle. The drain pump 78 may be used to drain liquid from the remote sump 82, through a drain conduit 88, and out of the dishwasher 10.

Referring to FIGS. 2 and 4, the sump inlet conduit 84, tub sumps 42, 48, remote sump 82, recirculation pump 76, spray arm assemblies 56, 58, and conduits 60-66 collectively form a liquid flow path of the liquid supply system 52. A filter 90 is provided within the liquid flow path such that soil and foreign objects may be filtered from the liquid. As illustrated, the filter 90 is located in the housing 80. The filter 90 may be a fine filter, which may be utilized to remove smaller particles from the liquid. The filter 90 may be a rotating filter as is set forth in detail in U.S. patent application Ser. No. 12/643,394, filed Dec. 21, 2009, and titled "Rotating Drum Filter for a Dishwashing Machine," which is incorporated herein by reference in its entirety. The rotating filter according to U.S. patent application Ser. No. 12/643,394 may be operably coupled to an impeller of the recirculation pump 76 such that when the impeller rotates the filter 90 is also rotated. While not illustrated, at least one an additional filter and/or coarse strainer can be located between the tub sumps 42, 48 and the remote sump 82 to filter larger soils and debris but allow smaller particles to pass through. An additional filter may be provided for each compartment 14, 16, and may be a strainer which is provided at each of the tub sumps 42, 48.

Figure 5:
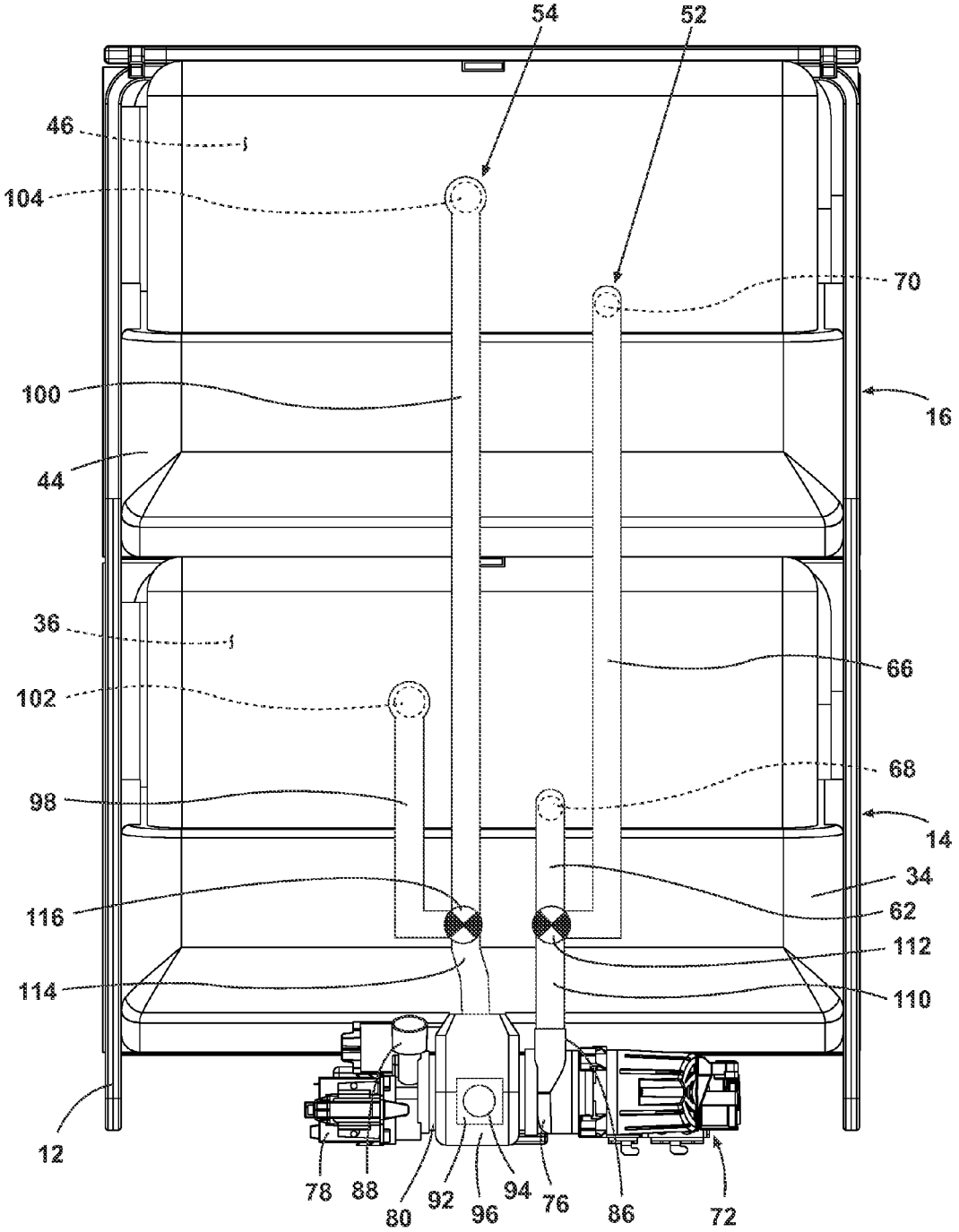
FIG. 5 is a rear view of the dishwasher of FIG. 1.

FIG. 5 is a rear view of the dishwasher 10 of FIG. 1. The air supply system 54 includes a fan or blower 92 having a blower inlet conduit 94 in fluid communication with the ambient surroundings to intake air from the exterior of the dishwasher 10 and a blower outlet conduit 96 for providing air to the treating chambers 36, 46 via one or more air conduits. As illustrated, the air supply system 54 includes a first air conduit 98 fluidly coupled to the lower tub 34 for supplying air to the lower treating chamber 36 and a second air conduit 100 fluidly coupled to the upper tub 44 for supplying air to the upper treating chamber 46. As illustrated, a portion of the blower outlet conduit 96 may wrap around the housing 80, such that the housing 80 defines an inner wall of the blower outlet conduit 96. In this manner, the housing 80 is a shared wall of the liquid supply system 52 and the air supply system 54, which places the liquid supply system 52 and the air supply system 54 in conductive contact. One or more valves or other closing means (not shown) may be used to close off the fluid connection between the blower outlet conduit 96 and the tubs 34, 44 during certain portions of the cycle of operation so that liquid does not enter the blower outlet conduit 96. Inlet vents 102, 104 can be provided in each of the compartments 14, 16, and may be in fluid communication with air conduits 98, 100 for passing air into the treating chambers 36, 46. Additional outlet vents (not shown) can be provided in each of the compartments 14, 16 and may be in fluid communication with the surrounding air, either internal or external to the dishwasher, to allow air in the treating chambers 36, 46 to be discharged exteriorly of the tubs 34, 44. In some configurations, one or more additional blowers (not shown) may be provided to force air out the outlet vents to increase the drying speed.

Referring to FIG. 4, the remote system 72 can further include a heating element 106 common to both the liquid supply system 52 and the air supply system 54 for heating the liquid and air supplied to the treating chambers 36, 46. As illustrated, the heating element 106 is mounted to an exterior of the housing 80. More specifically, the heating element 106 is illustrated as mounted to an exterior of the housing 80 where the blower outlet conduit 96 wraps around the housing 80. In this location, the heating element 106 may heat air and heated liquid at the same time. Furthermore, in this location the heating element 106 is downstream of the blower 92, which protects the blower from exposure to the high temperatures generated by the heating element 106. Alternatively, the blower 92 can be located downstream from the heating element 106.

The heating element 106 can be a resistive heating element that is activated by a suitable electrical supply, such as a standard house line voltage to the heating element 106.

A standard house line voltage can be between about 110 and 120 volts. The heating element 106 can also be a variable thermal energy heater, which may be accomplished by altering the duty cycle (ratio of on/off states per unit time) of a fixed wattage heater, a variable wattage heater, or a combination of both. The heating element 106 can have a power rating of less than about 1800 watts. In general, the heating system can supply electricity at 15 amps with a voltage in the range of about 110 to 120 volts to the heating element.

As illustrated, the heating element 106 can be a flow-through heater incorporated with the recirculation pump 76 and having three rings 108 encircling the housing 80. The three rings 108 may be an integral unit or may function independently of each other. As an integral unit, the rings 108 can be part of a heating coil that uses a variable duty cycle to vary the thermal energy output by the heating element 106. As independent rings 108, a desired number of rings 108 can be selectively actuated to obtain the desired thermal energy output. For example, if the heating element 106 is to run at ⅓ thermal energy output, then only one of the three rings 108 can be continuously actuated. A combination of both approaches can be used as well, such as continuously running a subset of all of the rings 108, while operating another one or more of the rings 108 according to a duty cycle.

In addition to a coiled heater or multiple-ring heater, other heating element configurations may be used. For example, it has been contemplated that the heating element 106 may be a film heater mounted on the housing 80. The film heater may comprise one film or multiple films in much the same manner that the rings 108 may be a coil or individual elements.

It has also been contemplated that the heating element 106 may be mounted to the housing 80 and positioned such that it abuts a portion of the blower outlet conduit 96. In this manner, the blower outlet conduit 96 need not wrap fully around the housing 80. Instead the blower outlet conduit 96 may abut or partially envelope the housing 80. In such an instance, the heating element 106 may be mounted to the housing 80 where the blower outlet conduit 96 abuts or partially envelops the housing 80 such that the heating element 106 may heat the liquid in the housing 80 and the air in the blower outlet conduit 96. It should be noted that while the blower 92 has been illustrated as being fluidly coupled with the blower outlet conduit 96 upstream from the heating element 106 such that heated air does not pass through the blower 92, the blower 92 may also be located downstream from the heating element 106 such that heated air is passed through the blower 92.

Referring to FIG. 5, the dishwasher 10 can be configured to selectively supply liquid and/or air to only one of the compartments 14, 16. As illustrated, a liquid manifold 110 can fluidly couple the outlet conduit 86 of the recirculation pump 76 to the first and second supply conduits 62, 66. A liquid diverter 112 can be provided in the liquid manifold 110 for selectively directing liquid to one of the first and second supply conduits 62, 66. The liquid diverter 112 can also selectively direct liquid to both the first and second supply conduits 62, 66 at the same time. Likewise, an air manifold 114 can fluidly couple the blower outlet conduit 96 of the blower 92 to the first and second air conduits 98, 100. An air diverter 116 can be provided within the air manifold 114 for selectively directing air from the blower 92 to one of the first and second air conduits 98, 100. The diverters 112, 116 can be multi-position valves.

Figure 6:
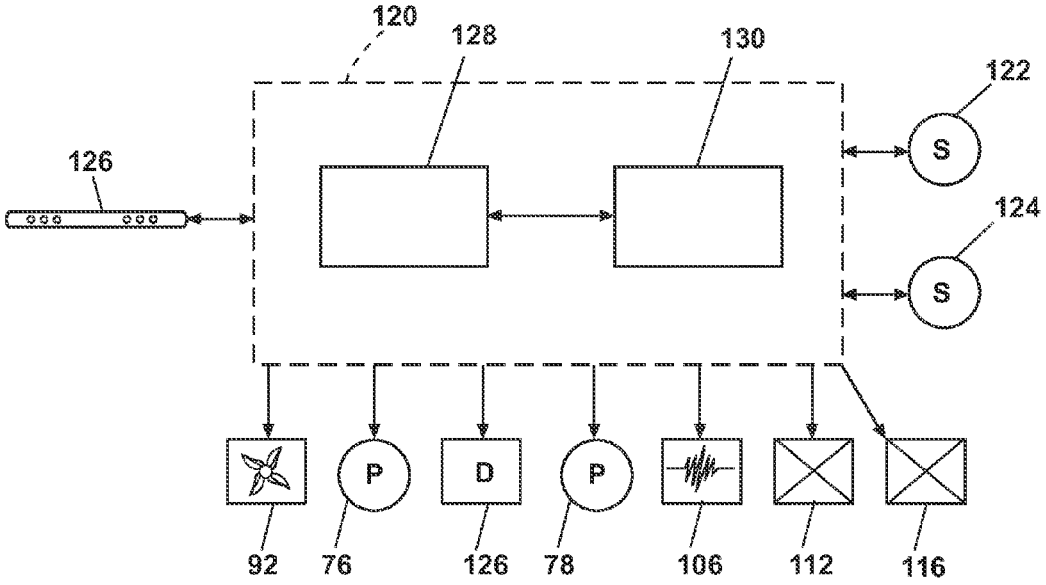
FIG. 6 is a schematic view of a controller of the dishwasher of FIG. 1.

FIG. 6 is a schematic view of a controller 120 of the dishwasher of FIG. 1. As illustrated, a single controller 120 can be provided for both compartments 14, 16, and may be operably coupled to various components of the dishwasher 10 to implement a cleaning cycle in one or both of the compartments 14, 16. For example, the controller 120 may be coupled with the recirculation pump 76 for circulation of liquid in the wash tubs 34, 44 and the drain pump 78 for drainage of liquid from the tubs 34, 44. The controller 120 may also be operably coupled with the blower 92 to provide air into the tubs 24, 44. The controller 120 may also be coupled with the heating element 106 to heat the liquid and/or air depending on the step being performed in the cycle of operation. If the heating element 106 is capable of supplying different wattages, then the controller 120 may also control that aspect of the heating element 106. The controller 120 may be coupled with the diverters 112, 116 for selectively providing air and liquid to the treating chambers 36, 46. The controller 120 may also be coupled with one or more temperature sensors 122, which are known in the art, such that the controller 120 may control the duration of the steps of the cycle of operation based upon the temperature detected in the treating chambers 36, 46 or in one of various conduits of the dishwasher 10. The controller 120 may also receive inputs from one or more other additional sensors 124, examples of which are known in the art. Non-limiting examples of additional sensors 124 that may be communicably coupled with the controller include a moisture sensor, a door sensor, a detergent and rinse aid presence/type sensor(s). The controller 120 may also be coupled to dispensers 126 provided in each of the compartments 14, 16, which may dispense a detergent during the wash step of the cycle of operation or a rinse aid during the rinse step of the cycle of operation. Alternatively, a single dispenser may be shared by both compartments 14, 16.

The dishwasher 10 may be preprogrammed with a number of different cleaning cycles from which a user may select one cleaning cycle to clean a load of utensils. Examples of cleaning cycles include normal, light/china, heavy/pots and pans, and rinse only. A control panel or user interface 126 for use in selecting a cleaning cycle can be provided on the dishwasher 10 and coupled to the controller 120. The user interface 126 can be provided above the upper compartment 16 and can include operational controls such as dials, lights, switches, and displays enabling a user to input commands to the controller 120 and receive information about the selected cleaning cycle. Alternately, the cleaning cycle may be automatically selected by the controller 120 based on soil levels sensed by the dishwasher 10 to optimize the cleaning performance of the dishwasher 10 for a particular load of utensils. The cleaning cycles may automatically dictate the supply of different fluids (i.e. air and/or water) to the treating chambers 36, 46.

The controller 120 may be provided with a memory 128 and a central processing unit (CPU) 130. The memory 128 may be used for storing control software that may be executed by the CPU 130 in completing a cycle of operation using one or both compartments 14, 16 of the dishwasher 10 and any additional software. For example, the memory 128 may store one or more pre-programmed cycles of operation that may be selected by a user and completed by one of the compartments 14, 16. A cycle of operation for the compartments 14, 16 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the compartments 14, 16 in any desired combination.

As illustrated herein, the controller 120 can be part of the remote system 72 to provide a compact and modular assembly for installation within the dishwasher 10, which also includes the pump assembly 74, filter 90, and heating element 106. However, one or more components shown as integrated with each other in the remote system 72 can also be provided separately. For example, while the heating element 106 is shown as integrated with other components in the remote system 72, each the heating element 106 can also be provided within its own independent heating system.

The above-described dishwasher 10 can be used to implement a method for operating a dishwasher having multiple, physically separate treating chambers. In operation of the dishwasher 10, air and liquid are heated by the common heating element 106, and the heated air and liquid are supplied to at least one of the treating chambers 36, 46. Depending on the supply of air and liquid to the blower outlet conduit 96 and the remote sump 82, air and liquid can be heated individually or simultaneously. FIG. 4 shows a portion of the liquid flow path of the liquid supply system 52, indicated by arrow A. As liquid enters the remote sump 82 via the sump inlet conduit 84, the liquid is heated by the heating element 106. The liquid can be heated via conduction with the housing 80. The heated liquid then exits the remote sump 82 via the outlet conduit 86, and is supplied to the liquid manifold 110 (FIG. 5). FIG. 4 also shows a portion of the air flow path of the air supply system 54, indicated by arrow B. The air can be heated by activating the blower 92 to pass air through the blower outlet conduit 96 to transfer heat from the heating element 106 by convective transfer. Alternatively, the air can be heated via the heated liquid, such as by passing air over the heated liquid to transfer heat directly from the liquid by conduction. The heated air then exits the blower outlet conduit 96, and is supplied to the air manifold 114 (FIG. 5).

In one embodiment, from the manifolds 110, 114, the heated air and liquid are supplied to different treating chambers 36, 46 by selectively diverting the heated air and liquid to different treating chamber 36, 46, using the diverters 112, 116. The heated air and liquid can be supplied to the different treating chambers 36, 46 simultaneously, or in a staggered fashion, as determined by the controller 120.

In another embodiment, liquid within the remote sump 82 may be heated by the heating element 106, but not supplied one of the treating chambers 36, 46. This may be useful in a scenario in which heated air alone is to be supplied to one of the treating chambers 36, 46. The liquid creates a heat sink around the filter 90 and absorbs at least some of the heat from the heated air and heating element 106 to aid in controlling the temperature of the filter 90 and surrounding structure. The heated liquid may then be drained from the dishwasher 10, or held until needed in one of the treating chambers 36, 46.

Figure 7:
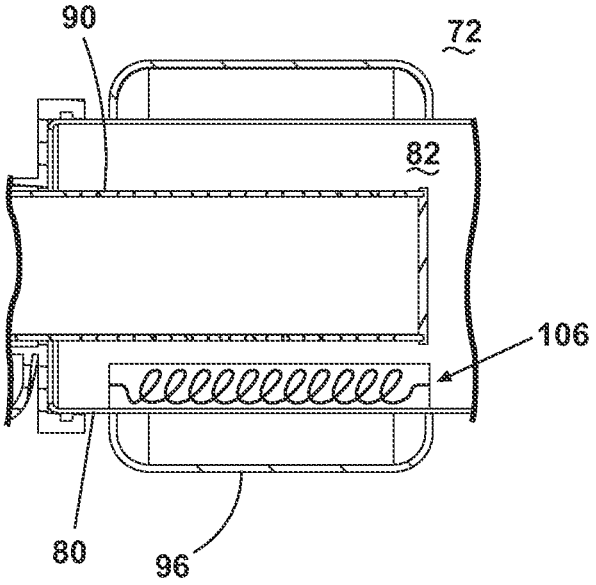
FIG. 7 is a schematic view of a portion of a remote pump/filtration/heating according to a second embodiment of the present invention.

FIG. 7 is a schematic view of a portion of the remote system 72 according to a second embodiment of the present invention. The second embodiment of the remote system 72 can be substantially identical to the first embodiment, with the exception that the heating element 106 can be mounted to the interior of the housing 80. More specifically, the heating element 106 is illustrated as mounted to the interior of the housing 80 with at least a portion of the heating element 106 located in the remote sump 82. In this location, the heating element 106 can still heat air and heated liquid at the same time, but will be at least partially immersed in liquid when liquid is present in the remote sump 82. In this embodiment, the air in the blower outlet conduit 96 can be heated by the heated liquid in addition to or alternatively to heating the air with the heating element 106. The heated liquid can transfer heat to the air by conduction, such as by through the housing 80.

Figure 8:
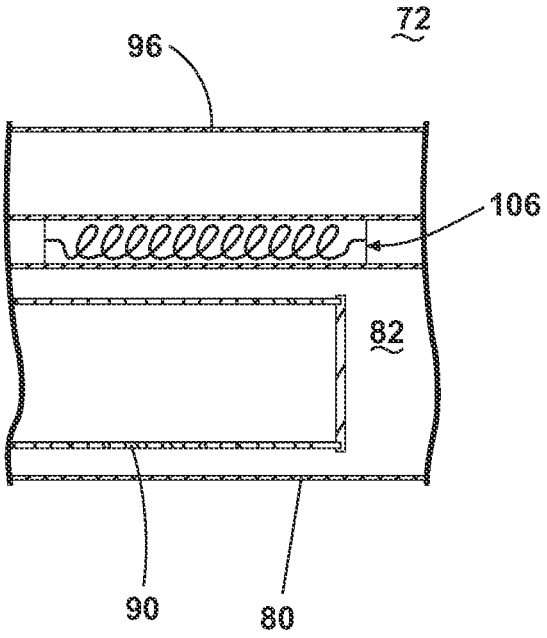
FIG. 8 is a schematic view of a portion of a remote pump/filtration/heating system according to a third embodiment of the present invention.

FIG. 8 is a schematic view of a portion of the remote system 72 according to a third embodiment of the present invention. The third embodiment of the remote system 72 can be substantially identical to the first embodiment, with the exception that the housing 80 and the blower outlet conduit 96 are provided in a side-by-side abutting relationship to define an interface between the housing 80 and the blower outlet conduit 96, and the heating element 106 is located at the interface. More specifically, the heating element 106 can be located between the housing 80 and the blower outlet conduit 96. In this location, the heating element 106 can still heat air and heated liquid at the same time, but heat will be conducted through the side walls of the housing 80 and the blower outlet conduit 96.

Figure 9:
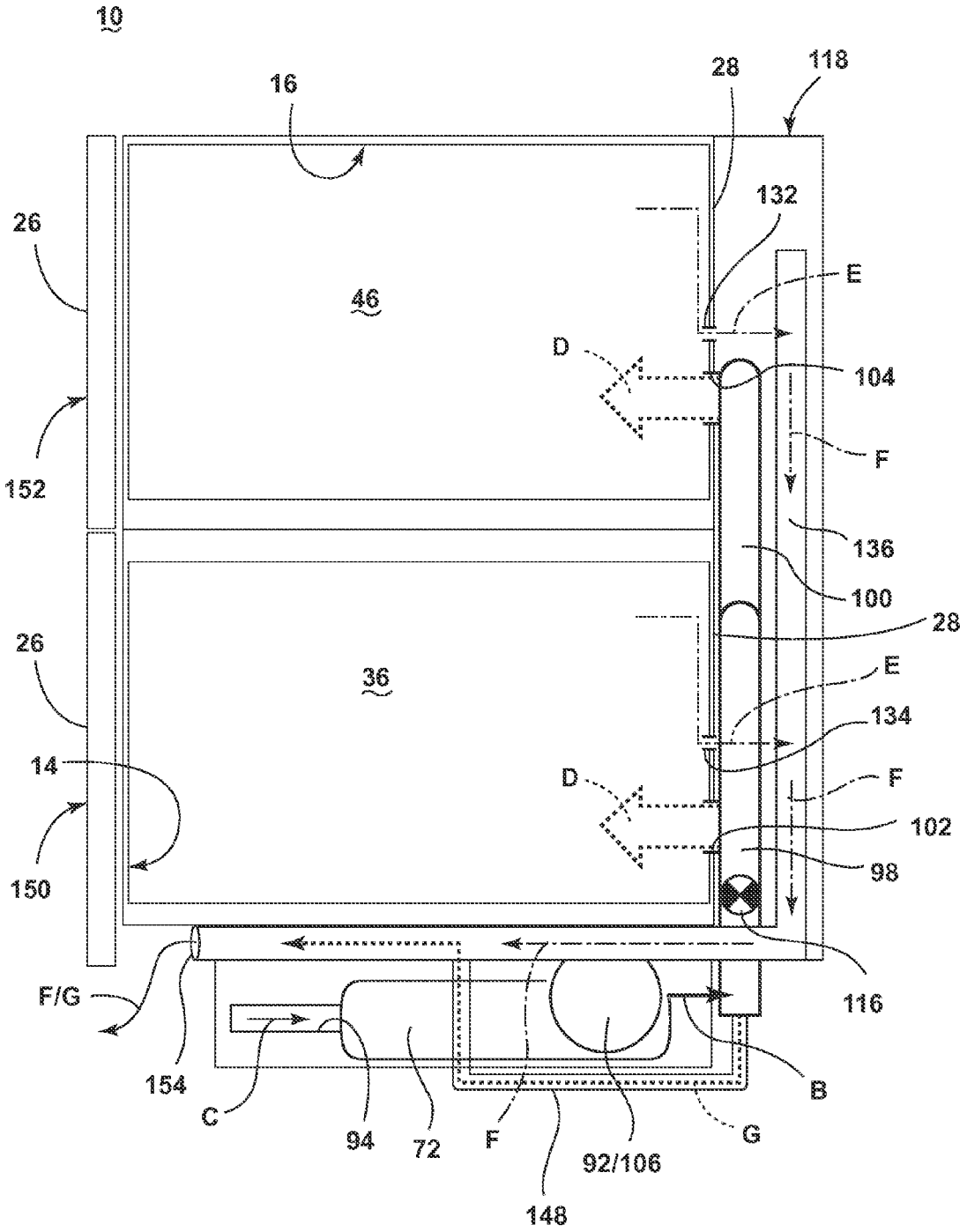
FIG. 9 is a schematic view of a portion of a multi-compartment dishwasher according to a fourth embodiment of the present invention.
Figure 10:
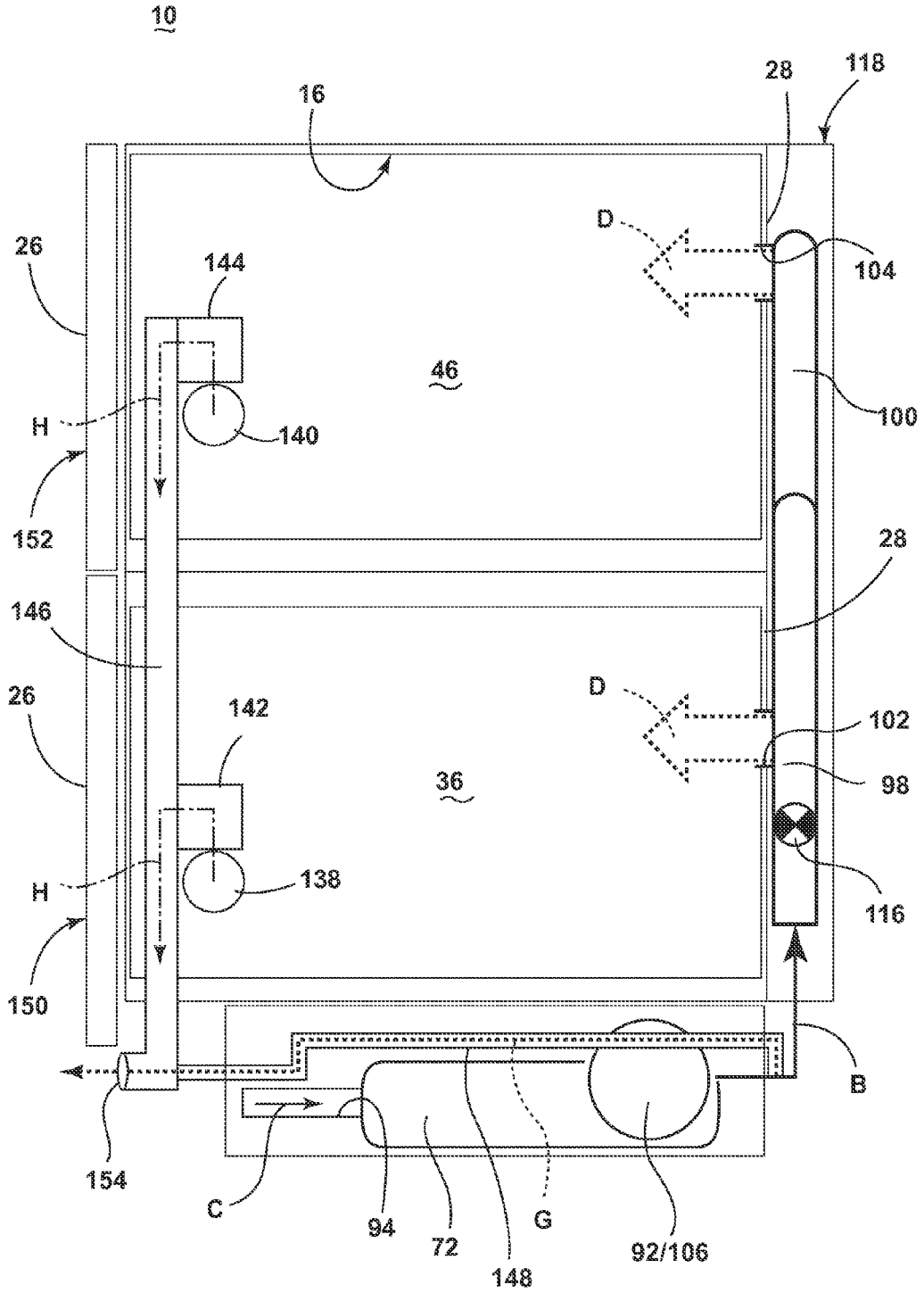
FIG. 10 is a schematic view of a portion of a multi-compartment dishwasher according to a fifth embodiment of the present invention.

FIGS. 9 and 10 schematically illustrate portions of the dishwasher 10 according to fourth and fifth embodiments, respectively, of the present invention. The fourth and fifth embodiment can be substantially identical to the first embodiment, with the dishwasher 10 including components directed to the introduction and exhaustion of drying air into and out of the compartments 14, 16. It should be understood that the first, fourth, and fifth embodiments may have somewhat differing components, such as a drying air and wash liquid heater, yet may share similar elements, features, and functions. Therefore, like elements/features may be identified with like reference characters unless otherwise noted. It should also be understood that like elements/features perform their associated functions in a like manner unless otherwise noted. Finally, FIGS. 9 and 10 illustrate the dishwasher 10 with 2 compartments. However, this is merely exemplary, and the number of compartments can be greater or fewer than 2.

Referring to the fourth embodiment in FIG. 9, the lower compartment 14 and upper compartment 16 are illustrated enclosed within a cabinet 118 extending from the front walls 26, over the upper compartment 16, along the rear walls 28 and sidewalls 32. The lower compartment front wall 26 can define a first front wall obverse face 150. The upper compartment front wall 26 can define a second front wall obverse face 152. The lower compartment front wall 26 can terminate somewhat above the surface on which the dishwasher 10 rests, defining an opening into a chamber beneath the lower compartment 14 extending to the rear of the dishwasher 10. The remote pump/filtration/heating system 72 can be located in the chamber below the lower compartment 14, or optionally in an alternate location, such as at the rear of the lower compartment 14.

The first air conduit 98 can extend along the exterior of the rear wall 28 of the lower compartment 14, while still remaining within the cabinet 118. The second air conduit 100 can extend along the exterior of the rear wall 28 of the lower compartment 14 and the upper compartment 16, while still remaining within the cabinet 118. The air conduits 98, 100 can be fluidly coupled with the blower 92 and heating element 106 as generally described previously herein, with the air diverter 116 fluidly coupled between the remote pump/filtration/heating system 72 and the air conduits 98, 100. The air conduits 98, 100 are illustrated as occupying a space between the rear walls 28 and the cabinet 118, although the air conduits 98, 100 can be optionally located along the exterior of the cabinet 118.

An exhaust air conduit 136 can extend, as illustrated, along the space between the rear walls 28 and the cabinet 118. Optionally, the exhaust air conduit 136 can be located along the exterior of the cabinet 118. In either configuration, the exhaust air conduit 136 can continue along the space below the lower compartment 14 to discharge exhausted air through an exhaust outlet 154 behind and beneath the lower compartment front wall 26.

Air, heated or not, can be selectively introduced into the lower compartment 14 and/or the upper compartment 16 through a lower inlet vent 102 and an upper inlet vent 104, as previously described herein. A lower outlet vent 134 can penetrate the rear wall 28 of the lower compartment 14 for fluidly coupling the lower treating chamber 36 with the exhaust air conduit 136. An upper outlet vent 132 can penetrate the rear wall 28 of the upper compartment 16 for fluidly coupling the upper treating chamber 46 with the exhaust air conduit 136.

Optionally, the lower and upper treating chambers 36, 46 can each be fluidly coupled with a dedicated exhaust air conduit (not shown), each of which can be configured for individual discharge of exhaust air from a treating chamber 36, 46. If the lower treating chamber 36 and the upper treating chamber 46 are fluidly coupled into a single exhaust air conduit 136, the lower treating chamber 36 and the upper treating chamber 46 can be fluidly coupled. Similarly, the lower treating chamber 36 can be fluidly coupled with the upper treating chamber 46 if dedicated exhaust air conduits are fluidly coupled.

After completion of a rinse cycle, and prior to the initiation of a drying cycle, the air in the treating chamber(s) 36, 46 can be very humid, if not saturated, and drops and pools of water can remain on the dishes. If hot water has been used in the wash and rinse phases, the air in the treating chamber (s) 36, 46 and the dishes can be very hot. Thermal mass, in the form of a full load of dishes, can store thermal energy from the hot wash and rinse liquids, and return thermal energy to the air after the completion of the wash and rinse phases. This can leave the treating chamber(s) 36, 46 holding hot, humid air for an extended period of time.

When the operation of the dishwasher 10 progresses to a drying cycle, relatively dry ambient air can flow (identified by the flow vector C) through the blower inlet conduit 94 into the remote pump/filtration/heating system 72. The air can be heated and can flow (identified by the flow vector B) into one or both of the heated air conduits 98, 100, as controlled by the air diverter 116. The air diverter 116 can be controlled by the controller 120 to selectively deliver heated air to the first air conduit 98 into the lower treating chamber 36, the second air conduit 100 into the upper treating chamber 46, or both treating chambers 36, 46 through both air conduits 98, 100.

Airflow into the treating chambers 36, 46 can be controlled by discretely supplying air to the treating chambers 36, 46; by alternatively supplying air to the treating chambers 36, 46; by alternating between supplying air and not supplying air to the treating chambers 36, 46; and by simultaneously supplying air to the treating chambers 36, 46. Thus, air can be delivered to the treating chambers 36, 46 at the same flow or different flows, or delivered only to one treating chamber, or any selected combination thereof, to provide a selected flow of air into a treating chamber according to the quantity, type, moisture content, and other characteristics, of a specific laundry load.

After air is delivered to at least one of the treating chambers 36, 46 (identified by the flow vectors D), the air can circulate through the at least one treating chamber 36, 46 to dry the utensils. Drying air, which may have cooled and gained moisture, can pass through the upper air outlet 132 and/or lower air outlet 134 into the exhaust air conduit 136 (identified by the flow vectors E), flow through the exhaust air conduit 136 (identified by the flow vector F) beneath the lower compartment 14, and exit the lower front of the dishwasher 10 through the exhaust outlet 154.

The exhaust airflow F may have a high relative humidity, which can result in condensation on devices in the vicinity of the exiting airflow such as furniture, cabinetry, utensils, aesthetic items, and the like. The initial exhaust airflow F can be relatively humid. However, lower humidity ambient air brought into the treating chamber(s) 36, 46 can have a greater capacity to hold humidity. Over time, the addition of ambient air to the exhaust airflow F can decrease the humidity of the exhaust air until it reaches a desired level for drying. To further control condensation, a portion G of the heated airflow B from the blower 92 and the heating element 106 can be diverted through a bypass air conduit 148 to merge with the airflow F through the exhaust conduit 136, which can lower the relative humidity of the exhaust air, and eliminate or minimize condensation.

Referring to the fifth embodiment in FIG. 10, a sidewall of the lower treating chamber 36 can be penetrated by a lower side vent 138 fluidly coupling the lower treating chamber 36 with an exhaust air conduit 146. A sidewall of the upper treating chamber 46 can be penetrated by an upper side vent 140 fluidly coupling the upper treating chamber 46 with the exhaust air conduit 146. The exhaust air conduit 146 can extend along the sidewalls of the lower and upper treating chambers 36, 46 externally of the chambers. This may position the exhaust air conduit 146 between the sidewalls and the cabinet 118.

A lower side vent blower 142 can be fluidly coupled between the lower side vent 138 and the exhaust air conduit 146. An upper side vent blower 144 can be fluidly coupled between the upper side vent 140 and the exhaust air conduit 146. The blowers 142, 144 can be operably coupled with and controlled by the controller 120. The blowers 142, 144 can facilitate the flow of drying air from the treating chambers 36, 46 through the side vents 138, 140 and into the exhaust air conduit 146.

Alternatively, the side vents 138, 140 can be fluidly coupled with the exhaust air conduit 146 without side vent blowers. Operation of the blowers 142, 144 to evacuate air from the treating chambers 36, 46 can lower the air pressure within the treating chambers, thereby facilitating the inflow of heated drying air from the first and second air conduits 98, 100. The blowers 142, 144 can be operated simultaneously, alternatingly, or in any other selected sequence.

As with the dishwasher 10 of FIG. 9, exhaust air flow H may have a high relative humidity, and the potential for compensation. Thus, to control compensation, a portion G of the heated airflow B from the blower 92 and heating elements 106 can be diverted through a bypass air conduit 148 fluidly coupled with the exhaust conduit 146. The combined low-humidity airflow G/H through the exhaust conduit 146 can be exhausted with a reduced potential for condensation through the exhaust outlet 154 below and behind the front wall 26.

The coupling of the bypass air conduit 148 with the exhaust air conduit 146 can be configured to promote the development of a venturi effect in the airflow, which may introduce a pressure differential to facilitate the flow of air through the opening 154 and away from the dishwasher 10.

The multi-compartment dishwasher 10 according to the invention can use a single heating element to heat both air and liquid for each compartment 14, 16, which can offer several advantages to the user. The flow of heated air or heated liquid to each compartment 14, 16 can be controlled so that the rate of consumption of these resources is commensurable with their rate of production by the dishwasher 10. This may also result in enhanced cleaning performance, since the entire volume of heated air and/or liquid can be supplied to only one of the compartments 14, 16 at a time. Further, activating only one heating element during a cycle of operation can reduce the power consumption of the dishwasher 10. This can also reduce the acquisition cost of the dishwasher 10, since fewer heating elements can be utilized.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to an automatic cycle of operation, comprising:

a first tub at least partially defining a first treating chamber;

a second tub at least partially defining a second treating chamber physically separate from the first treating chamber;

a liquid supply system fluidly coupled to the first and second treating chambers to selectively supply liquid thereto;

an air supply system fluidly coupled to the first and second treating chambers to selectively supply air thereto;

a heating system for heating the supplied air; and an air diverter coupled to the air supply system to selectively control a flow of air from the air supply system to the first and second treating chambers;

wherein the liquid supply system and the air supply system are configured such that liquid and air are independently supplied to the first tub and the second tub.

2. The dishwasher of claim 1 wherein the air diverter selectively controls the flow of air to the first and second treating chambers.

3. The dishwasher of claim 2 wherein the air diverter selectively controls the flow of air to the first and second treating chambers by discretely supplying air to the first and second treating chambers.

4. The dishwasher of claim 3 wherein the air diverter discretely supplies air to the first and second treating chambers by alternatively supplying air to the first and second treating chambers.

5. The dishwasher of claim 2 wherein the air diverter selectively controls the flow of air to the first and second treating chambers by alternating between supplying air and not supplying air to the first and second treating chambers.

6. The dishwasher of claim 5 wherein the supplying air to the first and second treating chambers comprises at least one of simultaneously supplying air to the first and second treating chambers and alternatively supplying air to the first and second treating chambers.

7. The dishwasher of claim 1 wherein the air supply system further comprises a first air outlet in the first treating chamber and a second air outlet in the second treating chamber.

8. The dishwasher of claim 7 wherein the first and second air outlets are fluidly coupled.

9. The dishwasher of claim 8 wherein the air supply system further comprises an exhaust conduit fluidly coupling the first and second air outlets.

10. The dishwasher of claim 9 further comprising a cabinet in which the first and second treating chambers are located.

11. The dishwasher of claim 10 wherein the exhaust conduit is located within the cabinet.

12. The dishwasher of claim 11 wherein the cabinet defines a sidewall and the exhaust conduit extends along the sidewall.

13. The dishwasher of claim 10 further comprising a first drawer defining at least a portion of the first tub, a second drawer defining at least a portion of the second tub, with each of the first and second drawers having a corresponding first and second face, wherein the exhaust conduit comprises an exhaust outlet located between the cabinet and one of the first and second faces.

14. The dishwasher of claim 10 further comprising a bypass air conduit extending from the air supply system upstream of the air diverter to the exhaust conduit.

15. The dishwasher of claim 1, further comprising a controller configured to selectively implement independent cleaning cycles in the first treating chamber and the second treating chamber.

16. A method of treating dishes in a dishwasher having physically separate multiple treating chambers, the method comprising:

selectively supplying liquid to the physically separate multiple treating chambers from a liquid supply system; and selectively supplying heated air to the physically separate multiple treating chambers from an air supply system by diverting heated air from the air supply system to the physically separate treating chambers;

wherein the liquid supply system and the air supply system are configured such that liquid and air are independently supplied to the physically separate multiple treating chambers.

17. The method of claim 16 wherein the diverting the heated air comprises selectively supplying heated air to each of the physically separate treating chambers.

18. The method of claim 17 wherein selectively supplying heated air comprises discretely supplying air to each of the physically separate treating chambers.

19. The method of claim 18 wherein the discretely supplying heated air comprises alternatively supplying heated air to each of the physically separate treating chambers.

20. The method of claim 16 wherein the selectively supplying heated air to the physically separate multiple treating chambers comprises at least one of simultaneously supplying air to the physically separate multiple treating chambers and alternatingly supplying air to the physically separate multiple treating chambers.

* * * * *